US006240742B1

(12) United States Patent
Kaufman et al.

(10) Patent No.: US 6,240,742 B1
(45) Date of Patent: Jun. 5, 2001

(54) MODULAR PORTABLE AIR-CONDITIONING SYSTEM

(75) Inventors: Jonathan W. Kaufman, Leonardtown; Paul A. Dolinar, Mechanicsville, both of MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/452,236

(22) Filed: Dec. 1, 1999

(51) Int. Cl.[7] ..... F25B 17/08

(52) U.S. Cl. ..... 62/480; 62/129; 62/313; 165/50

(58) Field of Search ..... 62/480, 125, 129, 62/239, 317; 165/50

(56) References Cited

U.S. PATENT DOCUMENTS 3,974,660 * 8/1976 Farr ..... 62/229
3,977,467 * 8/1976 Northrup, Jr. ..... 165/65
4,129,013 * 12/1978 Hine, Jr. ..... 62/285
4,169,500 * 10/1979 Braver ..... 165/50
4,549,405 * 10/1985 Anderson et al. ..... 62/239
4,841,742 * 6/1989 Biby ..... 62/420
5,277,036 * 1/1994 Dieckmann et al. ..... 62/291
5,697,224 * 12/1997 Sumida ..... 62/125
6,000,458 * 12/1999 Watanabe ..... 165/11.1

FOREIGN PATENT DOCUMENTS 84-295537 * 11/1984 (DE) ..... 62/480

* cited by examiner

*Primary Examiner*—William Doerrler
*Assistant Examiner*—Melvin Jones
(74) *Attorney, Agent, or Firm*—Ron Billi

(57) ABSTRACT

A modular air-conditioning system is disclosed and consists of a power supply module, blower module(s), air-conditioning module(s), and an air-distribution module. The power module may be comprised of batteries, whereas the blower module provides ventilation through the air-conditioning system that extracts heat from the flow of fluid and directs the extracted heat to a heat exchanger. The heat exchanger is a closed-low pressure system consisting of a liquid filled with a water adsorbing material. The heat is extracted from boiling liquid in a lower chamber of the heat exchanger and transferred to an upper chamber of the heat exchanger by way of heat and mass transfer.

22 Claims, 6 Drawing Sheets

MODULAR PORTABLE AIR-CONDITIONING SYSTEM

ORIGIN OF THE INVENTION

The invention described herein was made in the performance of official duties by an employee of the Department of the Navy and may be manufactured, used, licensed by or for the Government for any governmental purpose without the payment of any royalty thereon.

BACKGROUND OF THE INVENTION 1.0 Field of the Invention

The present invention relates to an air-conditioning system and, more particularly, to an air-conditioning system that is portable and modular so that it may be capable of being carried and moved about and can be arranged into many configurations so as to meet various thermal, filtration and power requirements.

2.0 Description of the Prior Art

A person's ability to accurately and repeatedly perform assigned tasks is dependent, in part, on the temperature of the environment in which the person is placed. If the environment can be maintained at a relatively constant temperature at a relatively low humidity, such as achievable by air-conditioning systems, the ability of a person to successfully perform the tasks increases.

Air-conditioning systems that clean air and control the humidity and temperature of the air are well known and find plentiful usage in stationary buildings, as well as moving vehicles. However, once the air-conditioning system is situated at a location in the building or moving vehicle, it commonly remains there for its operational life.

In addition to stationary air-conditioning systems, man-mounted, portable air-conditioning systems find usage in domestic and commercial buildings, but once again, once the air-conditioning system is situated at a location it commonly remains at that location for the remainder of its operational life. It is desired to provide an air-conditioning system that is easily capable of being carried and moved about so that it may be easily relocated so as to satisfy various thermal requirements in various buildings.

Air-conditioning systems, both stationary and portable types, are commonly removed and replaced with other air-conditioning systems so as to meet various thermal, filtration and power requirements as the need thereof arises within a building. It is desired that an air-conditioning system be constructed with module units so as to provide flexibility to satisfy various thermal, filtration and power requirements.

OBJECTS OF THE INVENTION

It is a primary object of the present invention to provide an air-conditioning system having modular construction so that it may be configured to provide flexibility in satisfying various thermal, filtration and power requirements as the need thereof arises.

It is a further object of the present invention to provide an air-conditioning system that is portable and man-mounted so that it is capable of being carried and moved about in order to satisfy various thermal, filtration and power requirements as the need thereof arises.

It is a further object of the present invention to provide for a modular portable air-conditioning system that inefficient in its operation while at the same time is modular so as to provide add-on capabilities for the air-conditioning systems.

SUMMARY OF THE INVENTION

The present invention is directed to an air-conditioning system that is portable and man-mounted as well as having a modular construction.

In one embodiment of the present invention, an air-conditioning modular system comprises a heat exchanger, and means for transferring water from a reservoir to a heat adsorbing material. The heat exchanger comprises an upper compartment having entrance and exit ducts and containing a water adsorbing material. The heat exchanger further comprises a lower compartment having entrance and exit ducts and containing water and also housing heat-exchanging fins. The air-conditioning module utilizes tubes for interconnecting the upper and lower compartments of the heat exchanger. The pressures of the upper and lower compartments are maintained so as to reduce the boiling point of water therein to be near room temperature.

BRIEF DESCRIPTION OF THE DRAWINGS

These and other objects, features and advantages of the invention, as well as the invention itself, will become better understood by reference to the following descriptions when considered in conjunction with the accompanying drawings, wherein like reference numbers designate identical or corresponding parts throughout and wherein.

DETAILED DESCRIPTION OF THE PREFERRED EMBODIMENTS

Figure 1:
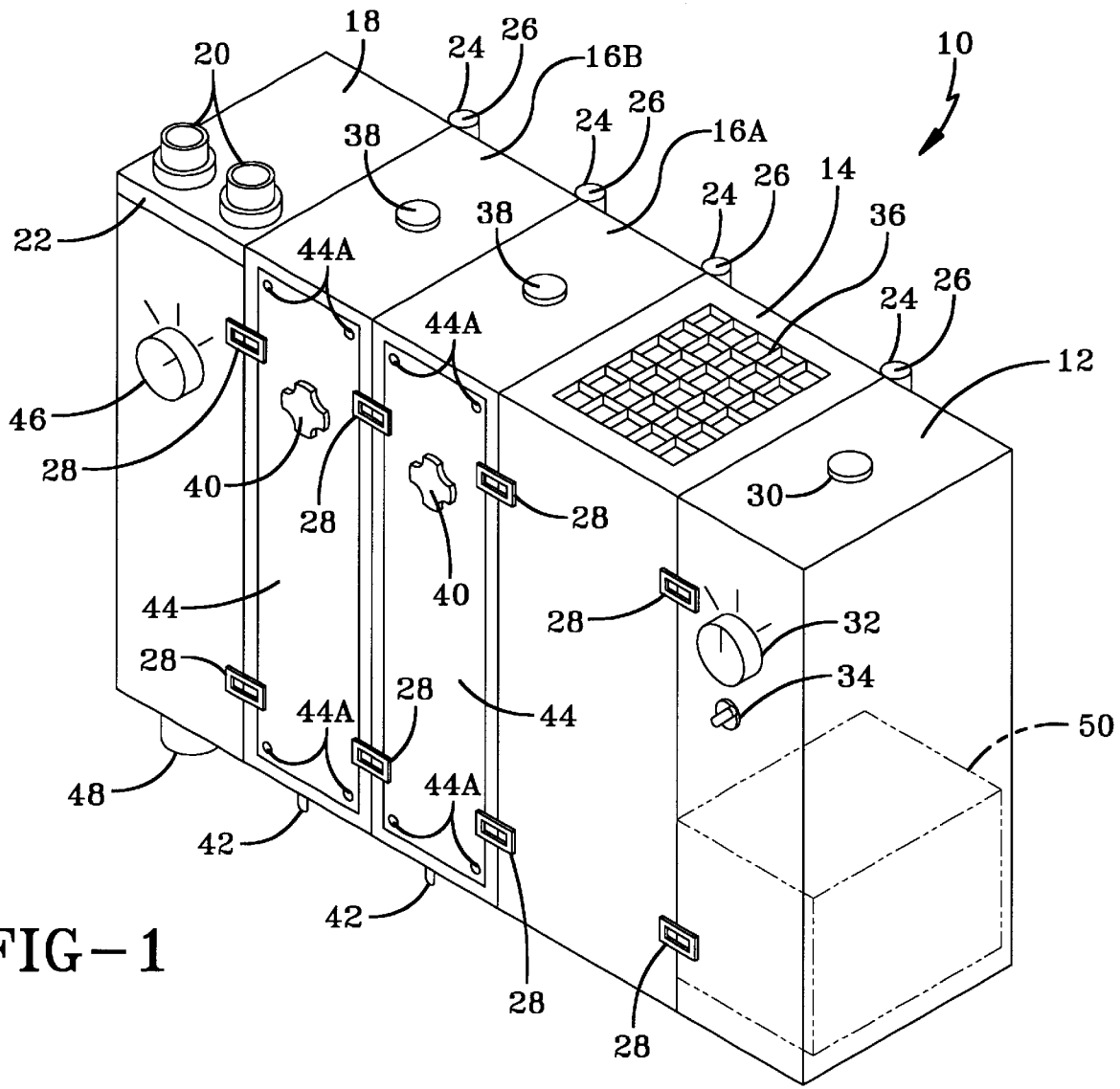
FIG. 1 illustrates the modular and portable air-conditioning system of the present invention.

With reference to the drawings, FIG. 1 illustrates a modular portable cooling system 10 existing of a series of modules and portable components that can be assembled in many configurations to meet various thermal, filtration and power requirements as the need thereof arises. The modular portable system 10 has overall and typical dimensions of 14 inches long, by 4 inches wide, and by 9 inches in height as viewed in FIG. 1. The modular components of the system 10 comprise a power module 12, a blower module 14, and one or more air-conditioning modules shown as 16A and 16B, and an air distribution module 18. The modular portable cooling system 10 preferably further comprises a filter module which may be a canister 20 or a flat plate filter device 22.

The modular portable cooling system 10 further comprises a knuckle arrangement 24 that operatively cooperates with a pin 26. The system 10 further comprises a plurality of latch mechanisms 28. The knuckle arrangement 24 and pin 26 serve as an arrangement for interconnecting the modules 12, 14, 16A, 16B and 18 together and the latch mechanism serves as a snap arrangement so that the power module 12, at least one air-conditioning module 16, and the air distribution module 18 may also be connected to each other.

The power module 12 preferably further comprises an indicator 30, a variable switch 32 and an On-Off switch 34. The blower module 14 preferably further comprises one or more inlet grills 36, whereas the air-conditioning module 16 preferably further comprises an indicator 38, a control valve 40, condensation drain valve 42, and a removable front base 44 having associated screw connectors 44A. The indicator 38 is provided, in a manner known in art, to indicate the heat exchanger's (to be further described with reference to FIGS. 3 and 4) conditioning efficiency and means that notify the user of the system 10 when the efficiency thereof falls below an acceptable level which, in turn, notifies the user that the heat exchanger needs to be replaced. The air distribution module 18 preferably further comprises a temperature control switch 46 and an exit port 48.

The power module 12 has typical dimensions of 2 inches long, by 4 inches wide, by 9 inches high. The power module 12 further comprises a portable electric source 50 such as, batteries or fuel cells, and a transformer to supply power excitation to the blower module 14. The transformer (not shown) is conventional and is used, in lieu of the batteries or fuel cells, when external power (e.g., aircraft power) can be exploited. Different operational environments present different external power opportunities. For example, a typical aircraft power operates at 115 VAC at 400 Hz, while ordinary household power operates at 110 VAC at 60 Hz and either may be connected to the transformer. Consequently, various power modules have specific transformers so as to provide for the desired input and output system requirements in a manner known in the art.

The On-Off switch 34 is operatively connected to the variable switch 32 so as to control the power (and speed) of the blower module 14. A meter or indicator 30 is preferably utilized, in a manner known in the art, to indicate the level of the available power of the power module 12, as well as to notify the user of the system when the batteries of the power source 50 need to be replaced. The electrical connectors (not shown in FIG. 1, but to be described with reference to FIGS. 2 and 3) are used to establish the interface between the power module 12 and the blower module 14. The power module 12 transfers power to the blower module 14. The blower module 14 has typical dimensions of 2 inches long by 3 inches wide by 9 inches high and has one or more grills 36 that serve as inlet ports for ventilation air. The blower module 14 can be further described with reference to FIG. 2.

Figure 2:
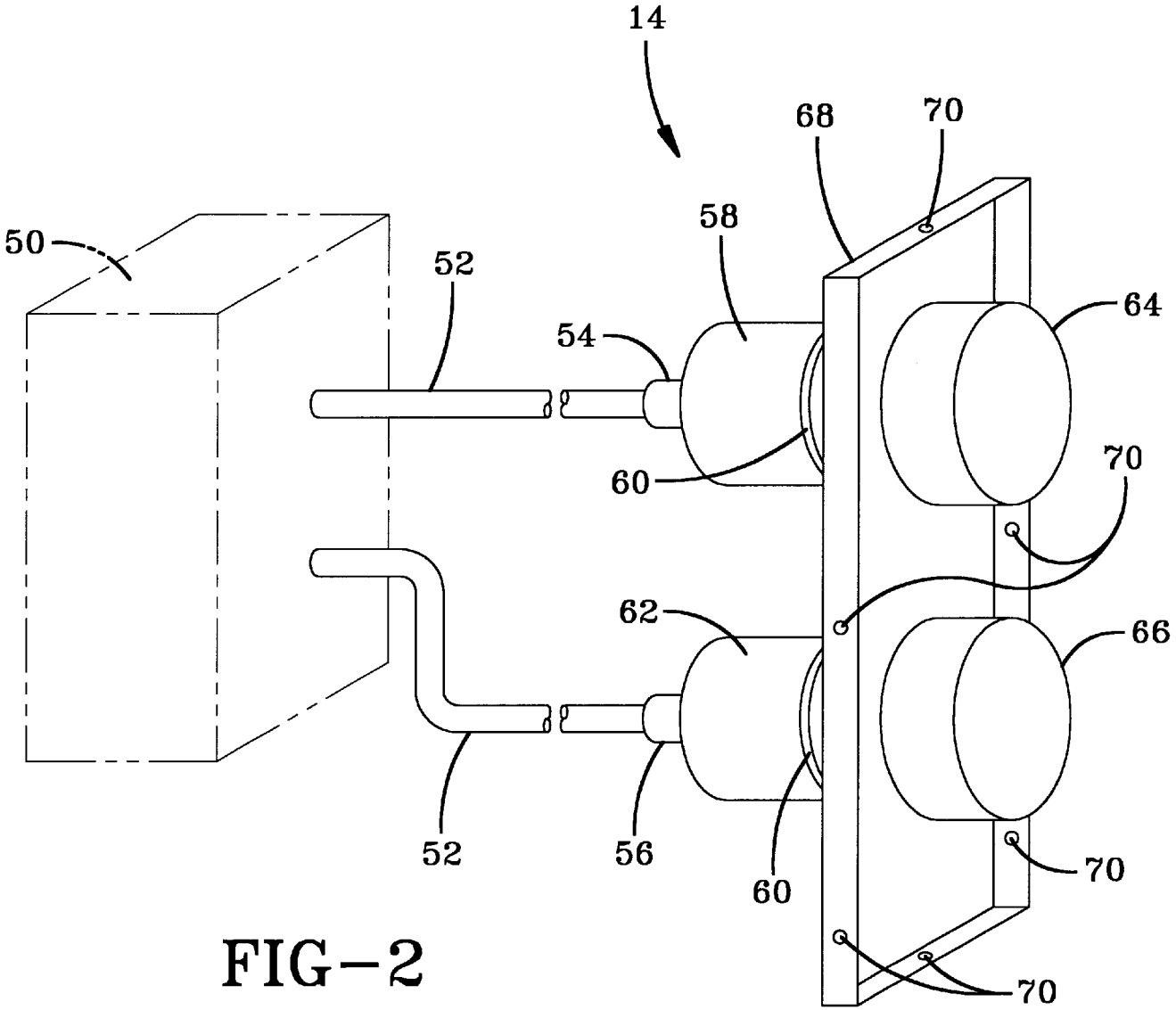
FIG. 2 illustrates further details of the blower module of the system of FIG. 1.

FIG. 2 schematically illustrates the blower module 14 and shows the power source 50 of the power module 12 as being interconnected to the blower module by way of a cable routing 52 having connectors 54 and 56. The connector 54 is connected to a blower or fan 58 having an 0 ring 60, whereas connector 56 is connected to a blower or fan 62 also having an 0 ring 60. The blower 58 may be operatively interconnected to a filter canister 64, whereas blower 62 may be operative interconnected to a filter canister 66. The filter canisters 64 and 66 are connected to a plate 68 which may be connected to the outer framing (not shown in FIG. 2) of the blower module 14 by way of pins (not shown) insert one into openings 70. The filter canister 64 serves as an upper canister in that it is arranged above the lower filter canister 66, whereas the blowers or fans 58 and 62 move air across the heat transfer surfaces of the air-conditioning module 16 which may be further described or referenced to FIG. 3.

Figure 3:
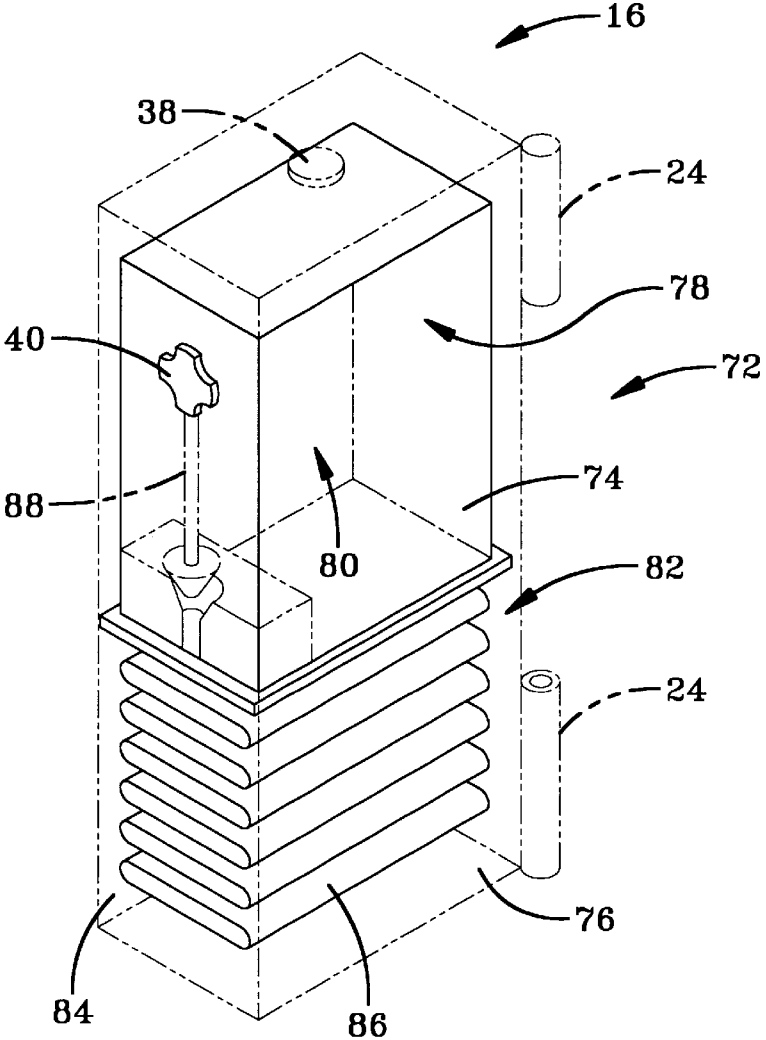
FIG. 3 illustrates a perspective view of the air-conditioning module of FIG. 1.

FIG. 3 is a perspective view of the air-conditioning module 16 which has typical dimensions of 4 inches long, by 4 inches wide, by 9 inches high and consists of a heat exchanger 72 with an upper compartment 74 used for heating and a lower compartment 76 used for cooling. The upper compartment 74 has entrance and exit ducts 78 and 80 respectively. Similarly, the lower compartment 76 has entrance and exit ducts 82 and 84 as well as heat exchanging fins 86. The upper compartment 74 is interconnected to the lower compartment 76 by means of the control valve 40 and a tube 88. The heat exchanger 72 may be further described with reference to FIG. 4.

Figure 4:
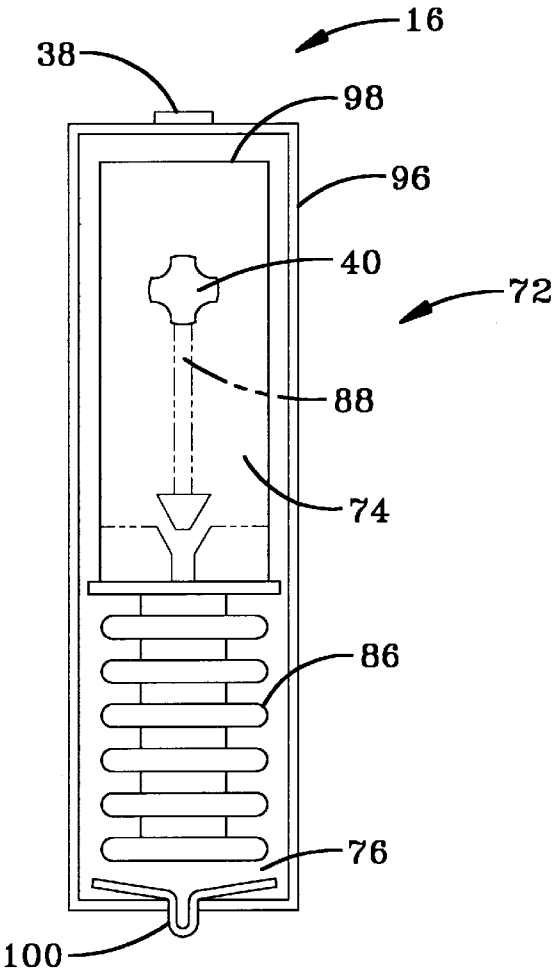
FIG. 4 illustrates a side view of the air-conditioning module of FIG. 1.
Figure 5:
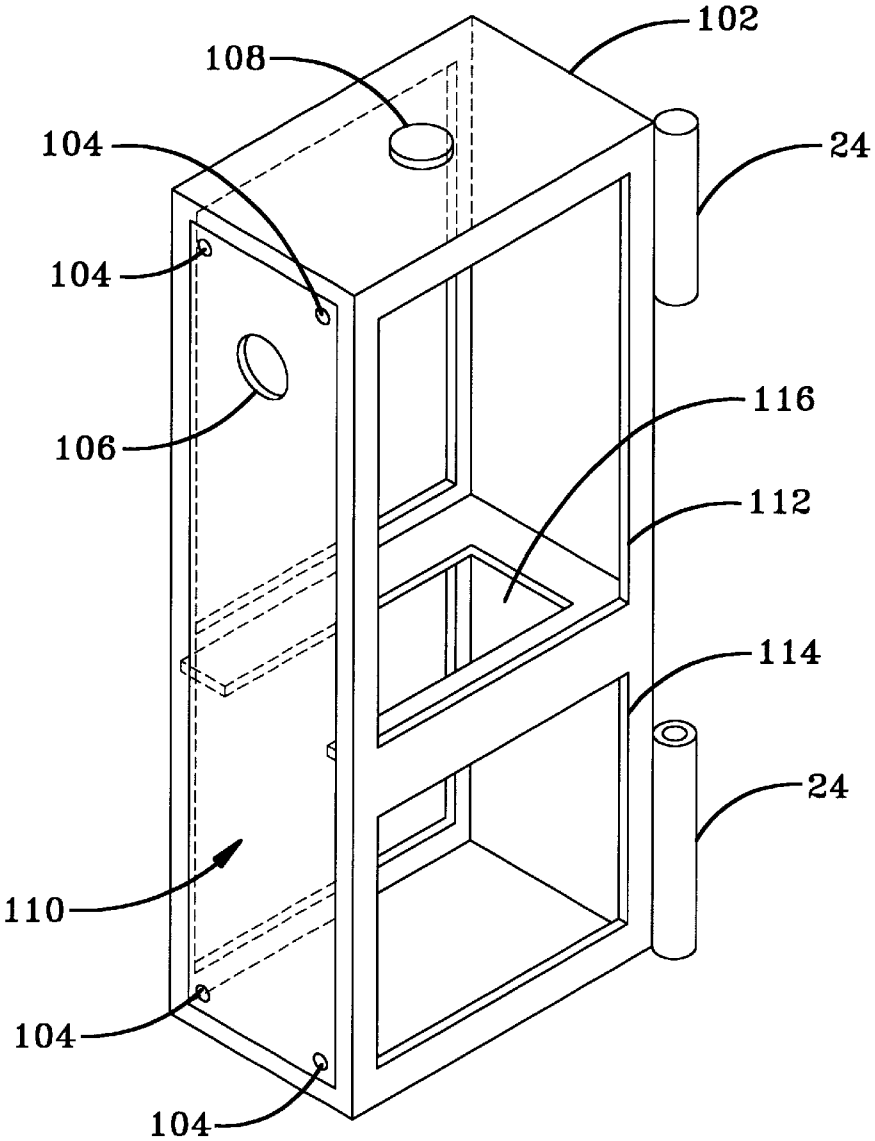
FIG. 5 illustrates the support structure for housing the air-conditioning module of FIG. 1.

The heat exchanger 72 shown in FIG. 4 mounts into the support structure of FIG. 5, to be described hereinafter, which connects via pins to other modules, thus providing for the heating and cooling airstreams also to be described hereinafter.

The upper compartment 74 contains a water adsorbing material, such as Zeolite and the cooling compartment 76 contains water. The cooling compartment 76 is heavily finned by means of heat exchanging fins 88 so as to maximize the heat exchange with ventilating air entering the blower module 14 in a manner as to be further described hereinafter with reference to FIG. 7. The fins 86 also act as conduits to transfer the water vapor produced by the boiling, of the water in the lower compartment 76, to the heating compartment 74 by way of control valve 40 and tubing 88. The heating compartment 74 is also heavily finned and consists of a metal casing 96 containing the adsorbing material 98. The lower cooling compartment 76 has a bottom portion wherein a condensing drain 100 is located.

The heat exchanger 72 operates in a normal matter in which heat is added or removed from a ventilatory airstream passing over the heated surface of upper chamber 74, or the cooled surface of lower compartment 76. The internal pressure of the heat exchanger 72, is maintained at a pressure low enough to reduce the boiling point of water in a lower compartment 76 to be near room temperature. The air-conditioning module 16 as the quick-removable base plate 44, shown in FIG. 1, which allows the heat exchanger 74 to be extracted and inserted into support structure 102 which may be further described with reference to FIG. 5.

The support structure 102 is preferably made from non-heat conductive material, such as plastic, and serves to provide the passageways to allow airflow between the heating and cooling compartments 74 and 76 respectively. Support structure 102 has a plurality of openings 104 which allows for the insertion of the screws 44A, shown in FIG. 1, and openings 106 and 110 which allow for the insertion of the control valve 40 and the indicator 38, respectively, also shown in FIG. 1.

Figure 6:
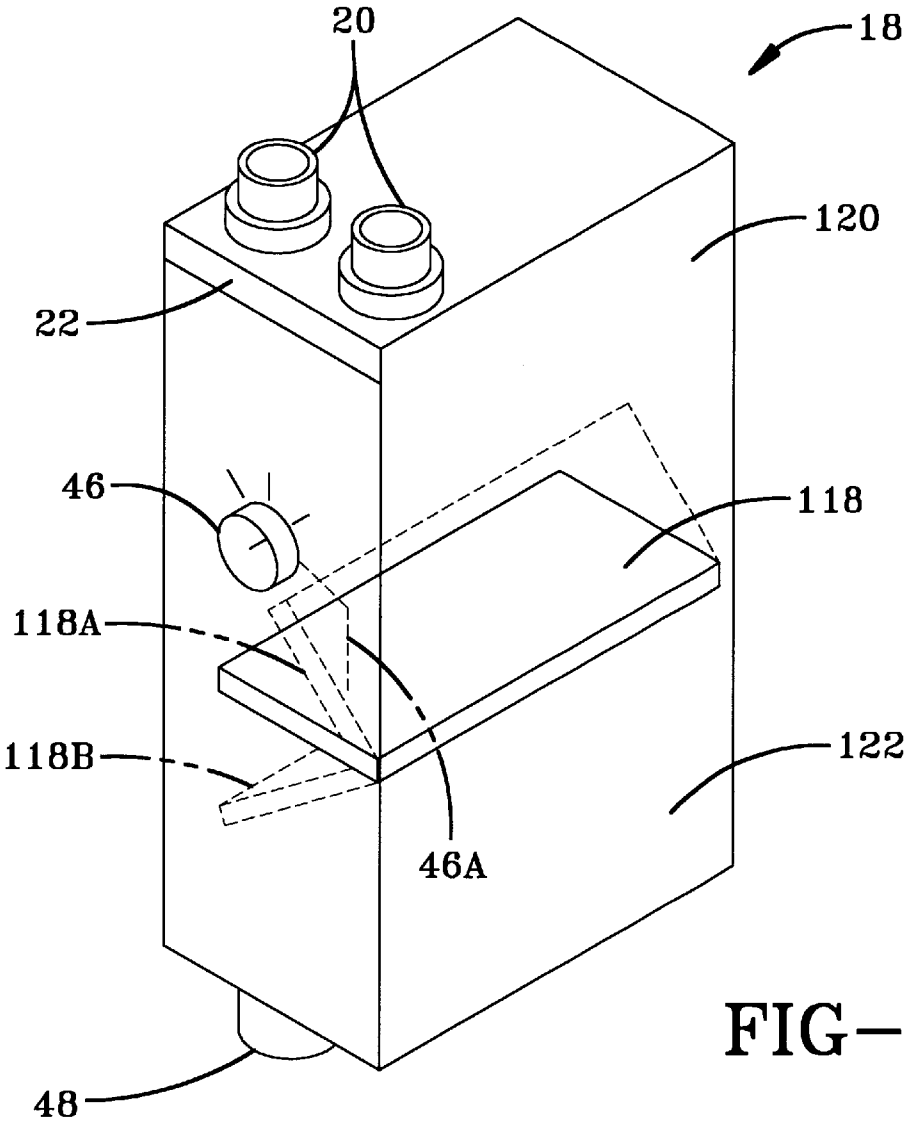
FIG. 6 schematically illustrates the air-distribution module of FIG. 1.

The support structure 102 has an opening on its face 110 which allows for the insertion of a quick-removable base plate 44, shown in FIG. 1. The support structure 102 further comprises windows plates 112 and 114 that are respectively in line with entrance ducts 78 and 82 of the heating and cooling compartment 74 and 76 respectively. In addition, the support structure 102 has an opening 108 that allows for the isolation of the warm and cool airstreams as well as the tubing 88 both shown in FIG. 3. The support structure 102 provides the passageways for fluid communication between the one or more air-conditioning modules 16A and 16B and blower module 14, while the air-conditioning module 16 provides cooling and heating air to the air distributing module 18 which may be further described with reference to FIG. 6.

The air-distribution module 18 has typical dimensions of 2 inches long by 4 inches wide by 9 inches high. It has an interior lodging a moveable manifold 118 which divides the interior into an upper passageway 120 and a lower passageway 122, each having an entrance and an exit section, with the entrance section of the upper passageway 120 being arranged so as to be in line with the exit duct of the upper compartment 74 of the air-conditioning module 16 and with the entrance section of the lower passageway 122 being arranged so as to being in line with the exit duct of the lower compartment 76 of the air-conditioning module 16. The manifold 118 is operatively connected to the control valve 46 by way of linkage 46A schematically shown in FIG. 6. The manifold 118, in response to the control valve 46 may be raised to an upper position 118A (shown in phantom) or a lower position 118B (also shown in phantom). In operation, there are two airstreams entering the air distribution module 18, one being a heated air stream from the heating compartment 74 of the air-conditioning module 12 and the other being a cooled air stream from the cooling compartment 76 of the air-conditioning module 12. The control knob 46 moving the manifold 118 controls the mixing of the entering air streams so that the temperature of the discharge air can be regulated before passing through either a fixed filter 22 having a plate-like shape or the canister filter 20. Waste conversion air is removed from the system by way of an exit port 48. The air distribution module 18 further comprises a purging system, not shown, but known in the art, which provides the ability for the filter modules 20 or 22 to be changed during the operation of the system 10, while still maintaining a clean environment for the system 10.

The filter 22 and/or 20 removes noxious materials from the system 10 when the system 10 is operating in a contaminated atmosphere. The filter module 20 or 22 accommodates various filter media. For example, the filter canister 20 may comprise a NATO C2 CB filtration material. The overall flow of the module portable air-conditioning system 10 may be described with reference to FIG. 7.

Figure 7:
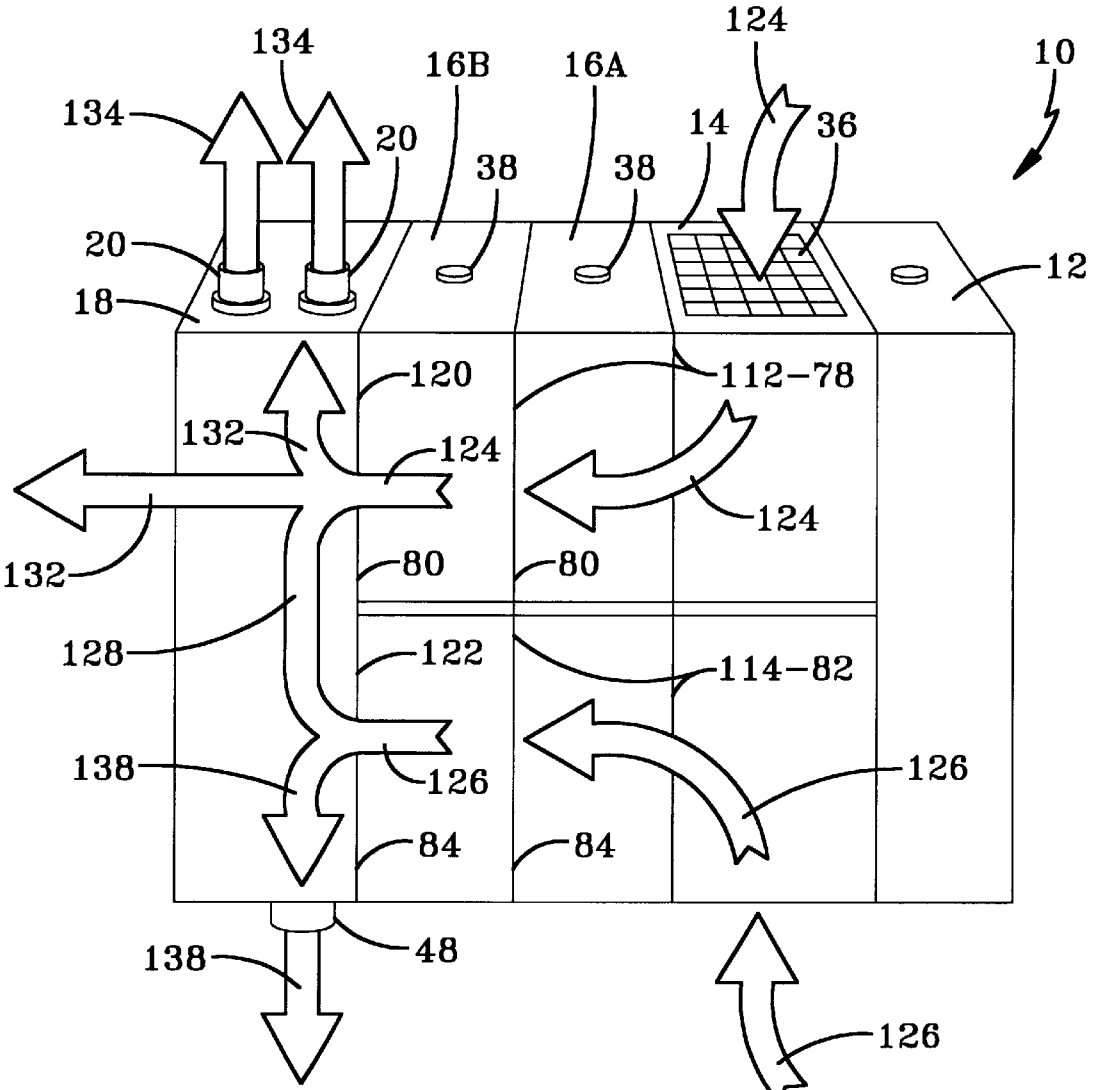
FIG. 7 illustrates the overall airflow associated with the modular portable air-conditioning system of FIG. 1.

As seen in FIG. 7, an upper inlet air stream 124 and a lower inlet air stream 126 are drawn into the system 10 by the blower module 14 by way of one or more grills 36 (upper grill 36 only shown). The air stream 124 exits the blower module 14 at canister 64 (see FIG. 2) and in to the opening 112 (see FIG. 5) of the support structure 102 as well as the entrance 78 (see FIG. 3) of the air-conditioning module 16A and, then, passes through the first air-conditioning module 16A by way of exit duct 80 (see FIG. 3) of the air-conditioning module 16 which is also aligned to the opening 112 of the support structure 102 for air conditioning module 16B and entrance duct 78 of the second air-conditioning module 16B.

Similarly, the air stream 126 exits the blower module 14 at canister 66 (see FIG. 2) and into opening 114 (see FIG. 5) of the support structure 102 as well as the entrance 82 of the lower compartment 76 of the air-conditioning module 16A and, then, passes through the lower compartment 76 and onto the exit duct 84 of the lower compartment 76. The air stream 126 then passes through the opening 114 of the support structure 102 for air-conditioning module 16B as well as the entrance port of the lower compartment 76 of the second air-conditioning module 16B. The upper end lower air streams 124 and 126 respectively exit the upper compartment 74 and the lower compartment 76 of the air-conditioning module 16B and respectively enter into the openings of 120 and 122 (see FIG. 6) of the air-distribution module 18.

The air streams 124 and 126 are mixed by the operation of the air-distribution module 18; in particular the manifold 118 and the control valve 46, shown by air stream 128. The waste air leaves the system 10 by way of the exit port 48 and is shown as air stream 138, whereas the conditioned air 132 leaves the forward face of the air-distribution module 18 in a straight through manner as shown in FIG. 7, with some of conditioned air 132 passing first through the canisters 20 and leaving the system 10 as the conditioned discharged air shown by directional arrows 134.

It should now be appreciated that the practice of the present invention provides for a air-conditioning system that consists of a power module 12, blower module 14, at least one air-conditioning module 16, and an air-distribution module 18, as well as having a preferred filter device 20 or 22. Because of the module construction, the different modules of the system 10 may be arranged in any fashion to satisfy various thermal, filtration, and power requirements.

It is understood that the invention is not limited to the specific embodiments herein illustrated and described but may be otherwise without departing in a sphere in scope of the invention.

The invention claimed:

1. A modular portable cooling system comprising:

(a) a power module making available power excitation at its output;

(b) a blower module having means for connecting to said power excitation and having at least first and second blowers excited by said power and each blower preferably having a filter canister with an input and an output and with one canister being an upper canister arrange a above the other canister which is a lower canister;

(c) an air-conditioning module including a heat exchanger comprising:

(i) an upper compartment having entrance and exit ducts and containing a water adsorbing material; said entrance duct being arranged in line with the lower canister of said blower module;

(ii) a lower compartment having entrance and exit ducts and containing water and also housing heat-exchanging fins, said entrance duct being arranged in line with the lower canister of said blower module; and (iii) tubing interconnecting said upper and lower compartments; and (iv) means fluidly coupled to said upper and lower compartments for maintaining pressure of said upper and lower compartments so as to reduce the boiling point of water near room temperature; and (d) at least one air-distribution module having an interior and a manifold which divides said interior into upper and lower passageways each passageway having entrance and exit sections with the entrance section of an upper passageway being arranged so as to be in line with the exit duct of said upper compartment of said heat exchanger and with the entrance section of the lower passageway being arranged so as to be in line with the exit duct of said lower compartment of said heat exchanger.

2. The modular portable cooling system according to claim 1, wherein said manifold is adjustable and said air-distribution module further comprises a control valve operatively connected to said adjustable manifold so that the upper and lower passageway have air streams that can be mixed with each other.

3. The modular portable cooling system according to claim 1, wherein said lower passageway of said air-distribution module has a bottom portion having mounted thereto an exit port.

4. The modular portable cooling system according to claim 1, wherein said air distribution module further comprises means for purging said interior of said air-distribution module of any contaminants therein.

5. The modular portable cooling system according to claim 1 further comprising filtering means for filtering air leaving the exit section of the upper passageway of the air-distribution module.

6. The modular portable cooling system according to claim 5, wherein said filtering means is a canister containing NATO C2 CB.

7. The modular portable cooling system according to claim 1, wherein said power module, blower module, at least one air-conditioning module, and air-distribution module each further comprises a pin and latch mechanism each dimensioned so that said power module, blower module, at least one air-conditioning module, and air-distribution module may be removeably interconnected to each other.

8. The modular portable cooling system according to claim 1, wherein said power module comprise at least one battery.

9. The modular portable cooling system according to claim 1, wherein said exchangeable power modules have an input and an output with said input having means for connecting to excitation selected from various groups including 115 VAC at 400 Hz and 115 VAC at 60 Hz.

10. The modular portable cooling system according to claim 9, wherein said means for connecting to said excitation includes a transformer.

11. The modular portable cooling system according to claim 9 wherein said output of said power module has an operatively connected On-Off switch and a variable switch.

12. A portable air-conditioning module comprising (a) a heat exchanger comprising;

(i) an upper compartment having entrance and exit ducts and containing a water adsorbing material;

(ii) a lower compartment having entrance and exit ducts and containing water and also housing heat-exchanging fins; and (iii) tubing interconnecting said upper and lower compartments; and (b) means for fluidly coupling between said upper and lower compartments and for maintaining pressure of said upper and lower compartments so as to reduce the boiling point of water to near room temperature.

13. The air-conditioning module according to claim 12, wherein said upper compartment comprises metal having a relatively high heat conductivity and having extrusions extending inward of an interior of said upper compartments.

14. The air-conditioning module according to claim 13, wherein said extrusions have a shape selected from the group consisting of fins and ribs.

15. The air-conditioning module according to claim 12, wherein said water-adsorbing material is Zeolite.

16. The air-conditioning module according to claim 12 further comprising at least one control valve fluidly coupled to said tubing.

17. The air-conditioning module according to claim 12 further comprising means for monitoring efficiency of operation of said heat exchanger.

18. The air-conditioning module according to claim 12, wherein said lower compartment has a bottom portion and wherein said air-conditioning module further comprises a discharge valve located at said bottom portion.

19. The air-conditioning module according to claim 12 further comprising a support structure dimensioned to house said air conditioning module.

20. The air-conditioning module according to claim 19, wherein said support structure is comprised of an insulative material and is dimensioned to allow insertion and extraction of said air-conditioning module.

21. The air-conditioning module of claim 20, wherein said insulative material is plastic.

22. The air-conditioning module according to claim 19, wherein said support structure has a pin and latch mechanism for removeably connecting to another structure.

* * * * *